US011369188B2

(12) United States Patent
Balderas

(10) Patent No.: US 11,369,188 B2
(45) Date of Patent: Jun. 28, 2022

(54) WEARABLE HITCH

(71) Applicant: Hugo Balderas, San Antonio, TX (US)

(72) Inventor: Hugo Balderas, San Antonio, TX (US)

( * ) Notice: Subject to any disclaimer, the term of this patent is extended or adjusted under 35 U.S.C. 154(b) by 0 days.

(21) Appl. No.: 16/748,935

(22) Filed: Jan. 22, 2020

(65) Prior Publication Data

US 2022/0110437 A1 Apr. 14, 2022

(51) Int. Cl.
*A45F 5/02* (2006.01)

(52) U.S. Cl.
CPC ..... *A45F 5/021* (2013.01); *A45F 5/022* (2013.01)

(58) Field of Classification Search
CPC .. A45F 5/021; A45F 5/022; A45F 2200/0575; A45F 5/00; B62B 5/068
USPC ..... 224/184
See application file for complete search history.

(56) References Cited

U.S. PATENT DOCUMENTS 4,699,303 A * 10/1987 Kline ..... A63B 55/408 224/667
2006/0196901 A1* 9/2006 Benk ..... A45C 13/38 224/184
2009/0057355 A1* 3/2009 Weiss ..... B62B 3/007 224/184
2015/0374103 A1* 12/2015 Lian ..... A45C 5/14 224/184

OTHER PUBLICATIONS https://boingboing.net/2016/07/21/rollaboard-luggage-trailer-hit.html; "Rollaboard luggage trailer-hitch for your butt"; Jul. 21, 2016 View referenced video 47 seconds and 1 minute and 14 seconds into the video to view the luggage trailer-hitch.

* cited by examiner

*Primary Examiner* — Corey N Skurdal
(74) *Attorney, Agent, or Firm* — John C. Cave; Gunn, Lee & Cave, P.C.

(57) ABSTRACT

A wearable hitch configured to attach to a person's belt and/or pocket with a lower member capable of receiving a handle from a wheeled article such as a pull golf cart or wheeled luggage. The wearable hitch has a first arm adjacent to a base member defining a first slot. The wearable hitch further comprises a curved second arm attached to the base member that defines a second slot. The second arm comprises a first member that is biased against the base member and an arcuate member.

13 Claims, 6 Drawing Sheets

WEARABLE HITCH

CROSS-REFERENCES TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to a removable hitch attachable to a person for aid in pulling an article that has wheels such as luggage or a golf cart.

2. Background of the Related Art

Generally a person must dedicate a hand to pull a wheeled article such as luggage and golf pull carts. There is a need for a hands-free device to permit a wheeled article to be attached to a person in a manner that is comfortable for the person. Other devices only utilize a singular connection point to a person's clothing which results in undue stress on the connection point of the device, stress on the article of clothing, and uncomfortable usage because the device will move back and forth from the body without a second attachment point.

SUMMARY OF THE INVENTION

The present invention is a wearable hitch capable of attachment to a person's pants or shorts. The wearable hitch has a base member with a first arm and a second arm with each arm forming a slot. The base member further comprises a straight upper member and a lower curved member. The second arm comprises a first member that is biased against the base member and an arcuate member. In use, the wearable hitch is attached to the person's pants with the person's belt sliding into the slot between the first arm and the upper member of the base member. The slot between the second arm and a portion of the curved lower member of the base member is slid into the pocket. The first slot secures the wearable hitch to the person's belt and the second slot secures the wearable hitch to the pocket. The handle of the article is then placed in the arcuate member. A wheeled article then may be pulled by the person without hands.

DETAILED DESCRIPTION OF THE INVENTION

Figure 1:
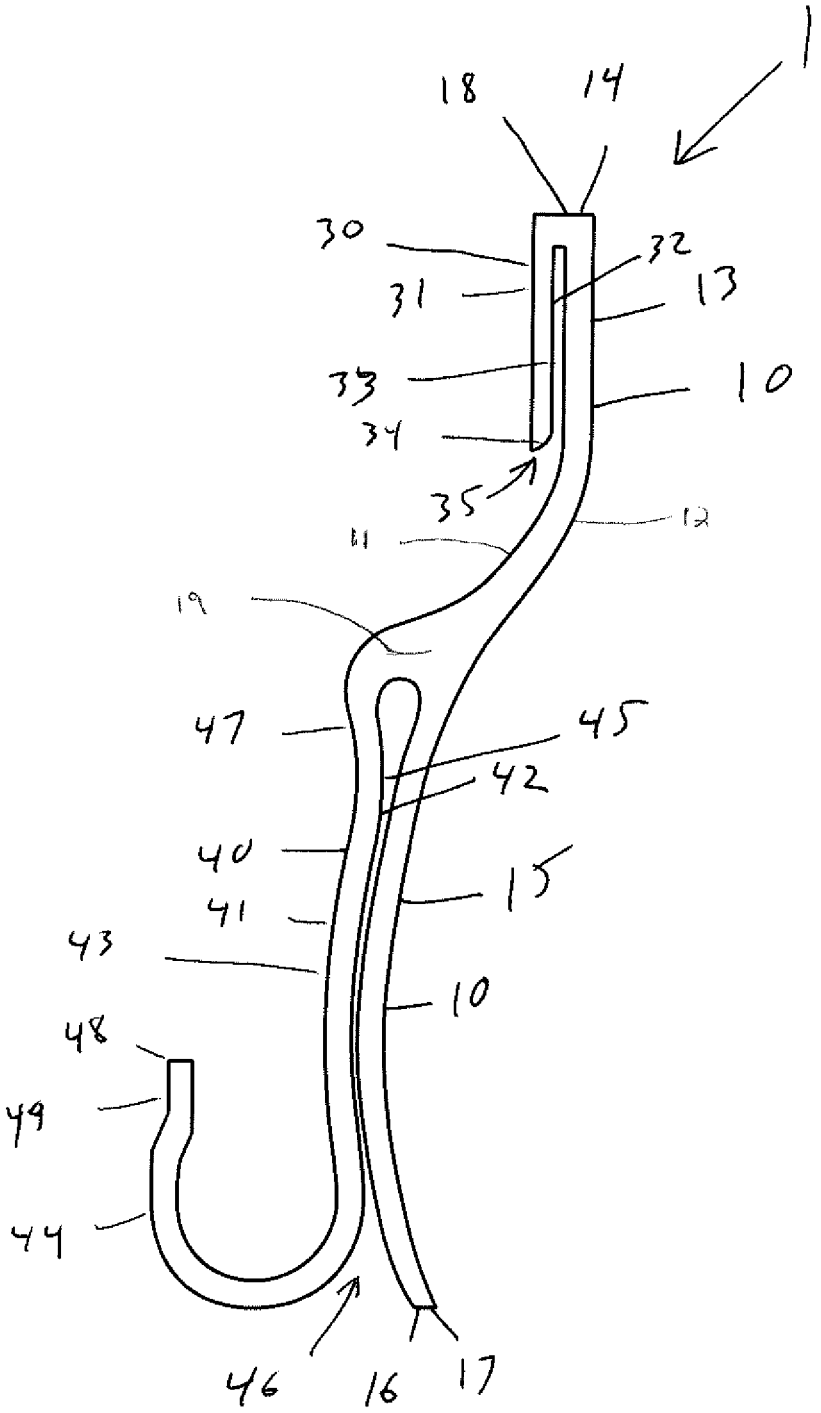
FIG. 1 is a side view of an embodiment of the present invention.
Figure 2:
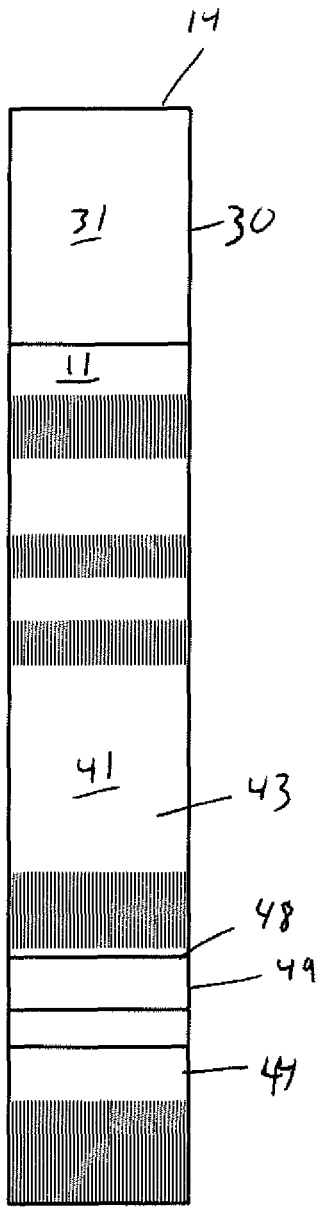
FIG. 2 is a front view of an embodiment of the present invention.
Figure 3:
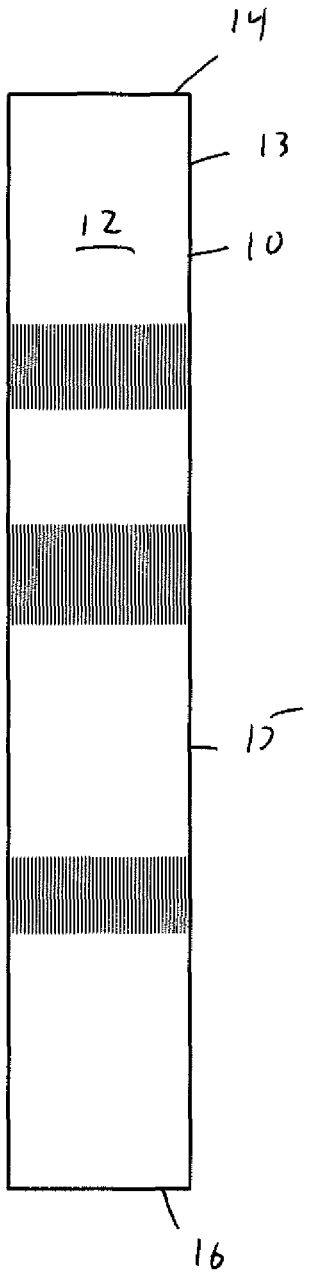
FIG. 3 is a back view of an embodiment of the present invention.
Figure 4:
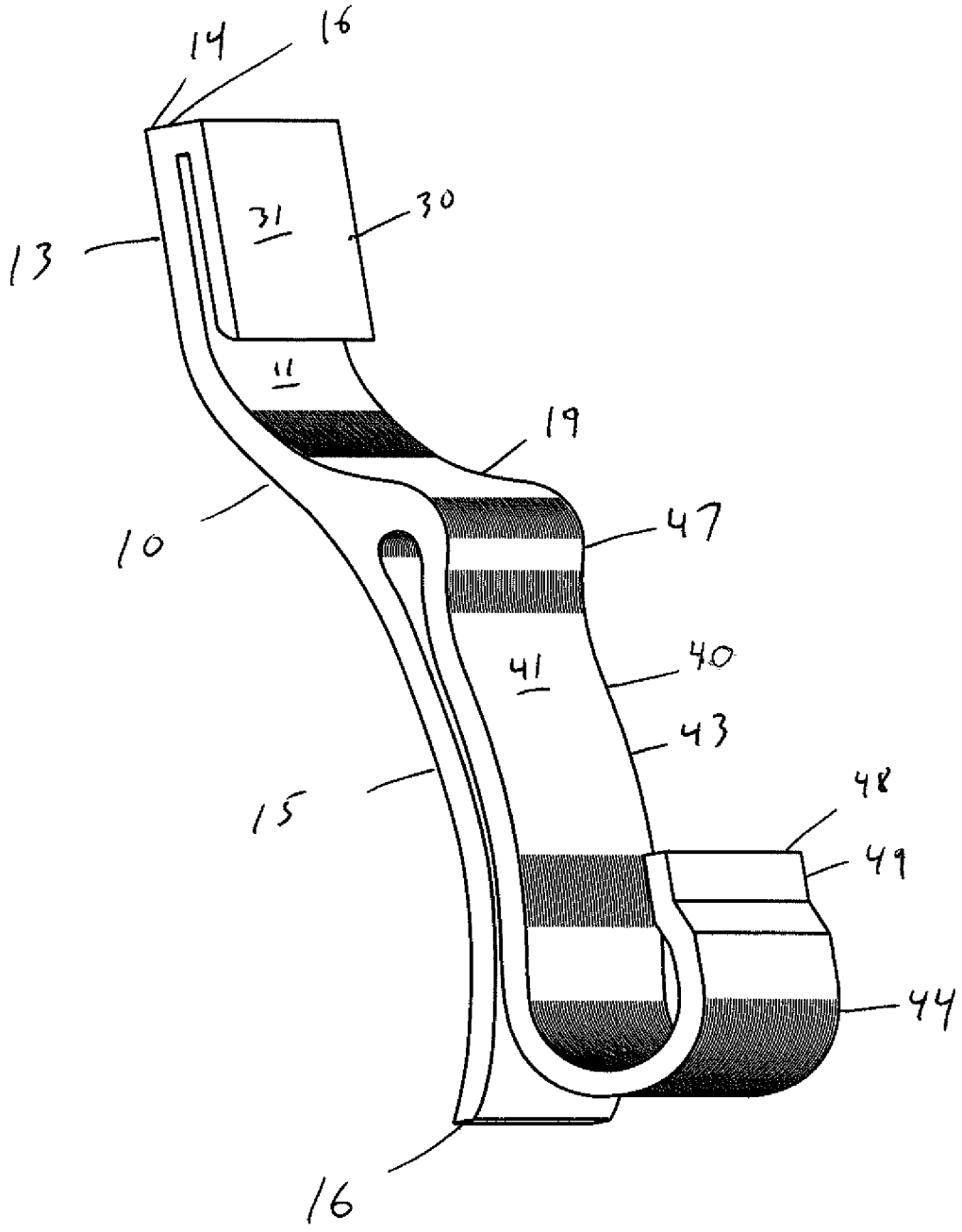
FIG. 4 is a front perspective view of an embodiment of the present invention.

As seen in FIGS. 1-4, the wearable hitch 1 comprises a base member 10, a first arm 30 and a second arm 40. The base member 10, having a front surface 11 and a back surface 12, comprises an upper member 13 that terminates at terminal edge 14 and a lower member 15 that terminates at terminal edge 16 having a tapered edge 17. The upper member 13 is generally straight. A first arm attachment point 18 is located at the terminal edge 14 along the front surface 11 of the base member 10. A second arm attachment point 19 is positioned along the lower member 15. In the preferred embodiment, the lower member 15 is generally arc shaped and corresponds to the shape of a user's buttocks.

A first arm 30 is connected to the first arm attachment point 18 of the base member 10. The first arm 30, having front surface 31 and a back surface 32, extends parallel to the front surface 11 of the upper member 13 such that a slot 33 is formed between the back surface 32 of the first arm 30 and the front surface 11 of the upper member 13. The first arm 30 is approximately the same length as the upper member 13 of the base member 10 and terminates at tapered edge 34. Preferably the lower member 15 curves under the first arm 30 and the opening 35 to the slot 33.

Alternatively, the first arm attachment point is positioned at the terminal edge 14 of the upper member 13 along the back surface 12. The first arm 30 then extends parallel to the back surface 12 of the upper member 13 such that a slot is formed between the first arm and the back surface 12 of the upper member 13.

A second arm 40 is connected to the second arm attachment point 19 of the base member 10. The second arm 40, having a front surface 41 and back surface 42, comprises a first member 43 and an arcuate member 44. The first member 43 extends from the second arm attachment point 19 generally parallel to the front surface 11 of the lower member 15 towards the terminal edge 16. A slot 45 having an opening 46 is formed between the second arm 40 and the lower member 15. A slight curvature 47 near the top of the first member 43 causes the second arm 40 to be biased towards the lower member 15 of the base member 10. The arcuate member 44 extends from the first member 43 away from the opening 46 and has a terminal end 48. The terminal end 48 further comprises a lip 49. The arcuate member 44 functions as hook with the ability to hold or support an item.

In the preferred embodiment, the length of the second arm attachment point 19 and the slight curvature 47 of the second arm 40 permit the second arm 40 to move towards or away from the lower member 15 of the base member 10 depending on the force applied. In the preferred embodiment the wearable hitch 1 is a single unitary construction made of a non-pliable plastic but may be made of another suitable material so long as the third arm is capable of movement in relation to an applied force.

Figure 5:
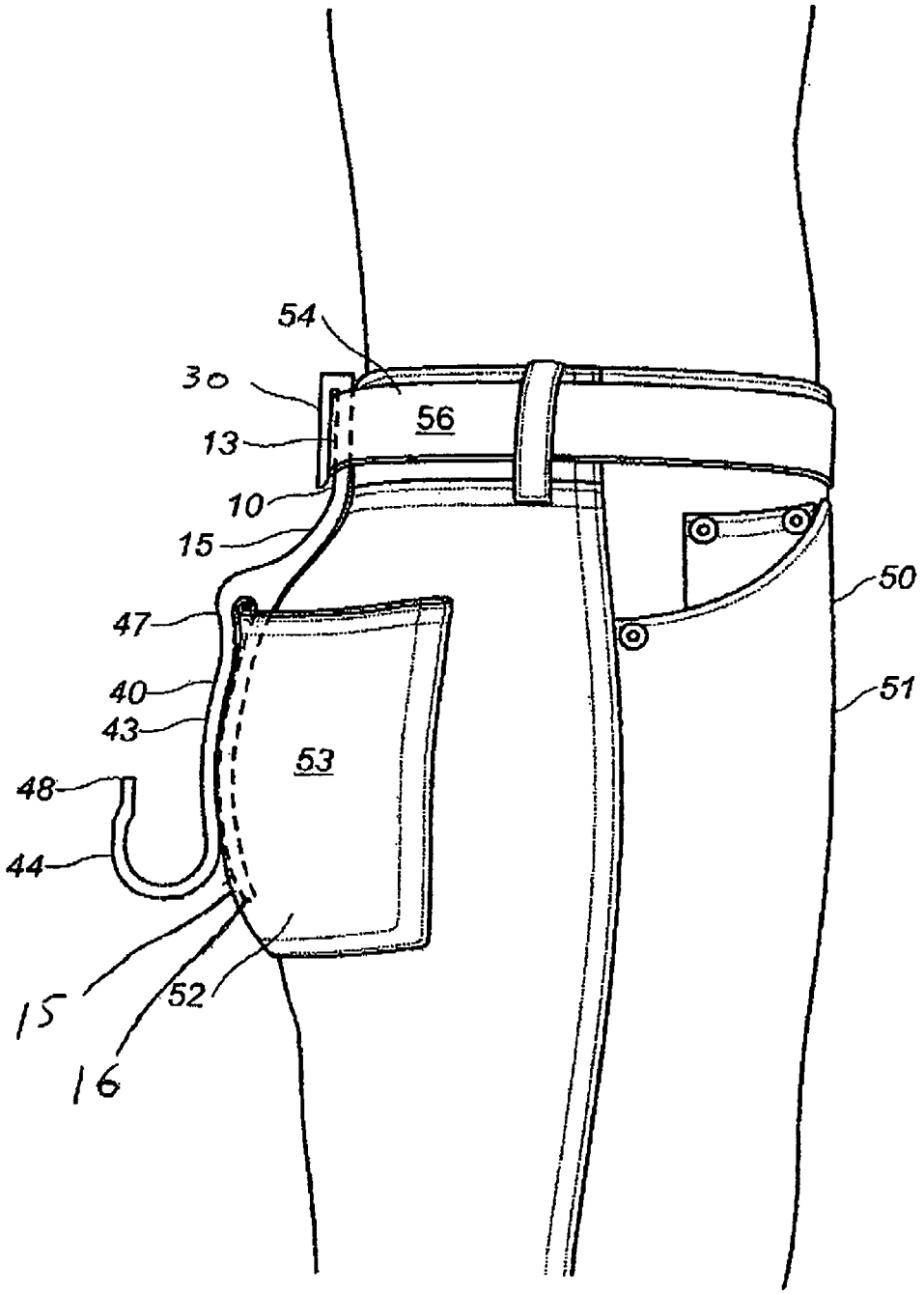
FIG. 5 is a side view of an embodiment of the present invention positioned attached to a user.
Figure 6:
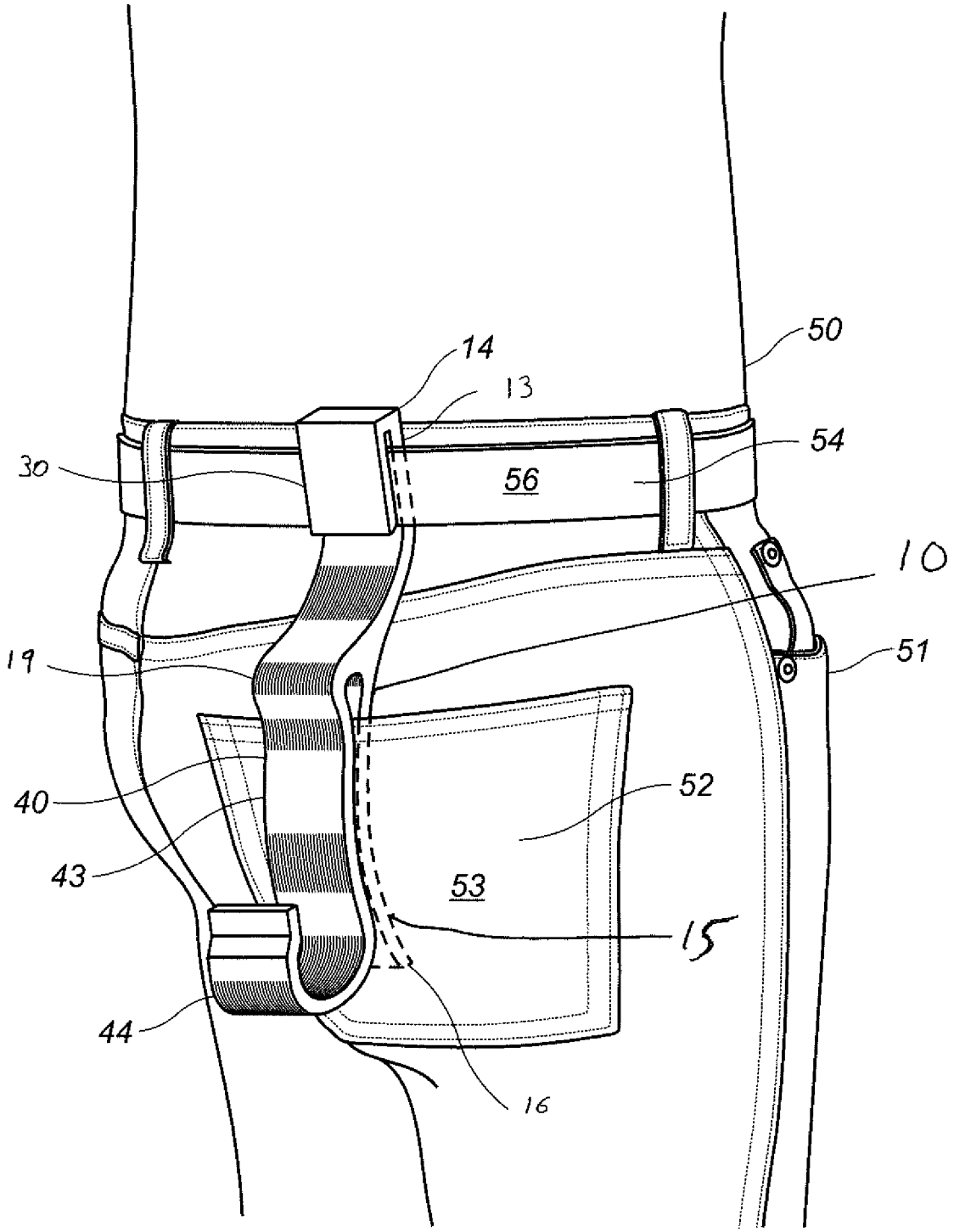
FIG. 6 is a perspective view of an embodiment of the present invention positioned attached to a user.
Figure 7:
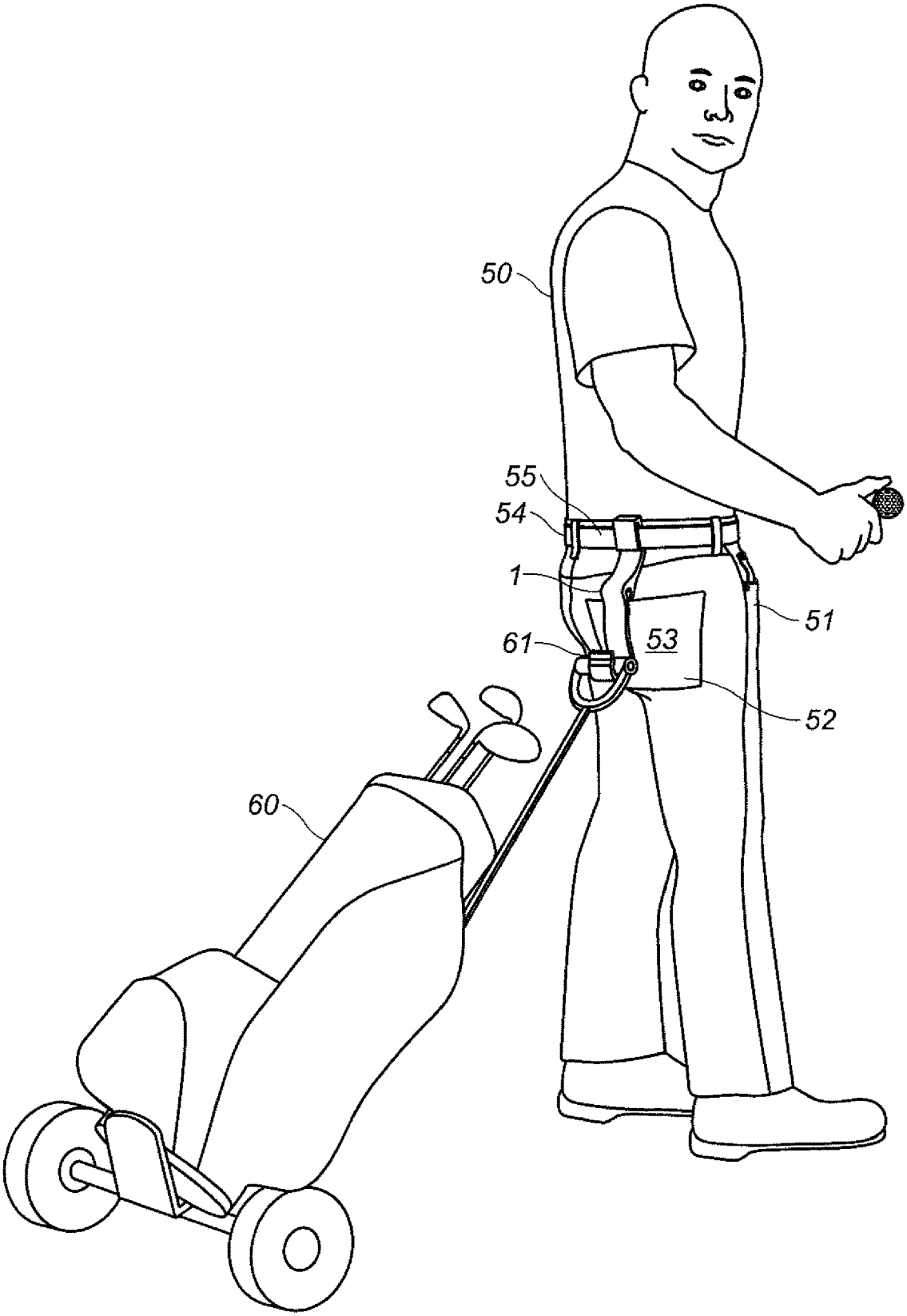
FIG. 7 is a perspective view of an embodiment of the present invention positioned attached to a user with a golf cart attached.

As seen in FIGS. 1 and 5-7 the wearable hitch 1 is attached to a user 50 and specifically the user's pants or shorts 51. Specifically the wearable hitch 1 is slid into pocket 52 through opening 46 and is positioned such that a portion of the lower member 15 of the base member 10 is within pocket 52 and the second arm 40 is outside the pocket 52. The bias of the second arm 40 causes the first member 43 to push against the surface 53 of the pocket 52 which then pushes the pocket 52 against the front surface 11 of the lower member 15 of the base member 10. The arcuate member 44 is positioned outside the pocket 52. Furthermore a portion of the user's belt 54 directly above the pocket 52 is inserted through opening 35 and into slot 33. The front surface 11 of the base member 10 is adjacent to the back surface (not shown) of the belt 54 and the back surface 32 of the first arm 30 is adjacent the front surface 56 of the belt 54. Once secured on the user 50 as described above, the wearable hitch 1 generally may not move from side to side within the pocket 52. The shape of the lower member 15 of the base member 10 permits the arcuate member 44 to be closer to the longitudinal axis of slot 33.

In the alternative embodiment, in which the first arm is adjacent the back surface 12 of the upper member 13, a portion of the user's belt 54, or the top of the user's pants, directly above the pocket 52 may be inserted in the opening between the first arm and the back surface 12 of the upper member 13.

In operation the handle of an article may be placed within the arcuate member 44. The lip 49 helps secure the handle within the arcuate member 44. If the article is wheeled, the user may walk with the handle of the article within the arcuate member 44. The position of the lower member 15 of the base member 10 within the pocket 52 prevents the wearable hitch 1 from moving away from the user 50.

In operation, the second arm attachment point 19 acts as a fulcrum with the base member 10 forming a curved lever. At rest, when the article is not being pulled or if an article is simply hung from the arcuate member 44 and is not in contact with the ground, the weight of the article 60 is directed downward from the arcuate member 44. This causes the terminal edge 16 of the base member 10 to slightly rotate toward the user and causes the terminal edge 14 of the base member 10 to slightly rotate away from the user. As a result, the force of the weight is distributed in generally three vectors: 1) along the user's belt 54 in a generally perpendicular downward vector relative to slot 33; 2) a generally parallel vector relative to slot 33 against the back surface of the belt 54; and 3) a generally parallel vector relative to slot 33 towards the user's buttocks.

When the article 60 is being pulled, the second arm 40, and specifically the arcuate member 44, is pulled away from the user. This causes the taper terminal edge 16 of the base member 10 to rotate away from the user, where it is restricted in movement by the pocket, and causes the terminal edge 14 to rotate towards the user. As a result, the force of the weight and the movement of the article is distributed in generally three vectors: 1) along the user's belt 54 in a generally perpendicular downward vector relative to slot 33; 2) a generally parallel vector relative to slot 33 against the front surface of the belt 54; and 3) a generally parallel vector relative to slot 33 away from the user.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A wearable hitch comprising:

a base member having an upper member and a lower member;

a first arm attached to the base member defining a first slot between the first arm and the upper member of the base member;

a second arm having a first member and an arcuate member;

wherein said first member of said second arm is attached to the base member at a position proximal to an upper end of said lower member of said base member;

wherein said second arm extends downward from said upper end of said lower member of said base member and defining a second slot between the first member of the second arm and the lower member of the base member; and further wherein the arcuate member of the second arm forms a hook extending away from the base member.

2. A wearable hitch of claim 1 wherein the first member of the second arm is biased towards the base member.

3. A wearable hitch of claim 1 wherein the upper member of the base member is straight and the lower member of the base member is curved.

4. A wearable hitch of claim 3 wherein the lower member of the base member extends underneath an opening to the first slot.

5. A wearable hitch of claim 4 wherein the lower member of the base member forms an arc.

6. A wearable hitch of claim 1 wherein the arcuate member further comprises a lip at its distal end.

7. A wearable hitch of claim 1 wherein the first arm is attached to a terminal end of the base member.

8. A wearable hitch comprising:

a base member having an upper member and a lower member;

a first arm attached to the base member defining a first slot between the first arm and the upper member of the base member;

a hook attached to the base member at a position proximal to an upper end of said lower member of said base member wherein said hook extends downward from said upper end of said lower member of said base member; and wherein said hook and said lower member of said base member define a second slot there between.

9. A wearable hitch of claim 8 wherein a portion of the hook is biased towards the base member.

10. A wearable hitch of claim 8 wherein the upper member of the base member is straight and the lower member of the base member is curved.

11. A wearable hitch of claim 10 wherein the lower member of the base member extends underneath an opening to the first slot.

12. A wearable hitch of claim 10 wherein the lower member of the base member forms an arc.

13. A wearable hitch of claim 8 wherein the first arm is attached to a terminal end of the base member.

* * * * *